US010316703B2

(12) United States Patent
Boese et al.

(10) Patent No.: US 10,316,703 B2
(45) Date of Patent: Jun. 11, 2019

(54) CAMSHAFT ADJUSTER AND STATOR COVER UNIT FOR AUTOMATIC ADJUSTMENT OF A LOCKING DEVICE

(71) Applicant: SCHAEFFLER TECHNOLOGIES AG & CO. KG, Herzogenaurach (DE)

(72) Inventors: Olaf Boese, Nuremberg (DE); Holger Brenner, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 342 days.

(21) Appl. No.: 14/381,066

(22) PCT Filed: Jan. 18, 2013

(86) PCT No.: PCT/EP2013/050890
§ 371 (c)(1),
(2) Date: Aug. 26, 2014

(87) PCT Pub. No.: WO2013/156165
PCT Pub. Date: Oct. 24, 2013

(65) Prior Publication Data

US 2015/0013636 A1 Jan. 15, 2015

(30) Foreign Application Priority Data

Apr. 18, 2012 (DE) ..... 10 2012 206 338

(51) Int. Cl.
*F01L 1/344* (2006.01)
*F01L 1/34* (2006.01)

(52) U.S. Cl.
CPC ..... *F01L 1/34* (2013.01); *F01L 1/3442* (2013.01); *F01L 2001/34469* (2013.01);
(Continued)

(58) Field of Classification Search
CPC ... F01L 2001/34483; F01L 2001/34453; F01L 2001/34469; F01L 1/3442
(Continued)

(56) References Cited

U.S. PATENT DOCUMENTS 6,276,321 B1 * 8/2001 Lichti ..... F01L 1/3442 123/90.17
6,311,654 B1 11/2001 Ushida et al.
(Continued)

FOREIGN PATENT DOCUMENTS

DE 101 63 791 7/2003
DE 10339871 A1 3/2005
(Continued)

*Primary Examiner* — Jacob M Amick
*Assistant Examiner* — Michael A Kessler
(74) *Attorney, Agent, or Firm* — Davidson, Davidson & Kappel, LLC

(57) ABSTRACT

A stator-cover unit (1) for a camshaft adjuster designed for use in an internal combustion engine, having a toothed ring (2) for receiving a torque, there being integrally connected to said toothed ring a stator (3) in the form of a housing, having a locking cover (4) which is separate from the stator (3), wherein the locking cover (4) is connected rotationally conjointly to the stator (3), wherein the stator (3) and the locking cover (4), at least during assembly, are held rotationally conjointly secured in said position by means of a projection (9) on one of the two components, which projection engages with a form fit into a recess (11) on the other of the two components. A camshaft adjuster having a rotor and having a correspondingly designed stator-cover unit (1), wherein a piston can be introduced, movably in an axial direction, into an opening of the locking cover (4).

19 Claims, 3 Drawing Sheets

(52) U.S. Cl.
CPC . *F01L 2001/34479* (2013.01); *F01L 2103/00* (2013.01); *F01L 2250/04* (2013.01)

(58) Field of Classification Search
USPC ..... 123/90.17
See application file for complete search history.

(56) References Cited

U.S. PATENT DOCUMENTS

| | | | | |
|---|---|---|---|---|
| 6,439,184 | B1 * | 8/2002 | Takenaka | F01L 1/34 123/90.17 |
| 7,225,774 | B2 | 6/2007 | Watanabe et al. | |
| 8,166,934 | B2 * | 5/2012 | Hertrich | F01L 1/3442 123/90.17 |
| 2008/0236528 | A1 | 10/2008 | Hertrich et al. | |
| 2011/0061616 | A1 | 3/2011 | Watanabe | |
| 2012/0291735 | A1 | 11/2012 | Wagner et al. | |
| 2012/0298061 | A1 | 11/2012 | Boese | |

FOREIGN PATENT DOCUMENTS

| | | |
|---|---|---|
| DE | 103 56 908 | 7/2005 |
| DE | 102005044572 | 3/2006 |
| DE | 10 2007 015064 | 10/2008 |
| DE | 10 2010 005602 | 7/2011 |
| DE | 10 2010 008 004 A1 | 8/2011 |
| DE | 10 2010 008 005 A1 | 8/2011 |

* cited by examiner

CAMSHAFT ADJUSTER AND STATOR COVER UNIT FOR AUTOMATIC ADJUSTMENT OF A LOCKING DEVICE

The present invention relates to a camshaft adjuster and a stator cover unit for a camshaft adjuster, which is designed for use in an internal combustion engine, including an annular gear for receiving a torque, on which a stator designed as a housing, is integrally mounted, including a locking cover, which is separate from the stator, the locking cover being mounted torsion-proof on the stator.

BACKGROUND

Camshaft adjusters are known from the prior art and are used in internal combustion engines, for example in passenger cars, trucks or other land-bound vehicles. However, they may also be deployed in other air-bound or water-bound vehicles which use internal combustion engines.

A device for changing the control times of gas exchange valves in an internal combustion engine is thus known from DE 10339871 A1. This publication relates to a device for changing the control times of gas exchange valves of an internal combustion engine, which is situated on the input end of a cam supported in the cylinder head of an internal combustion engine and which includes a drive unit which is in driving connection with a crankshaft and is axially delimited by two side covers as well as a drive unit which is rotatably fixedly connected to a camshaft and inserted into the drive unit. The output unit has an axial through-bore for a central fastening screw, while the drive unit has a central axial bore in the side cover facing away from the camshaft, through which the fastening screw is guided into the through-bore in the output unit. The axial bore may be closed pressure medium-tight with the aid of a screw plug provided with a sealant, which has a screw head suitably designed for engaging a tool and a hollow cylindrical screw shaft. The screw plug is designed as a one-piece light-weight integral part made of a thermoplastic plastic material for the axial bore in the side cover of the drive unit and its sealant, a fiberglass-reinforced polyamide being used as the plastic.

Stator cover units for camshaft adjusters are known from the publications DE 10 2010 008 004 A1 and DE 10 2010 008 005 A1, an integral design including a stator and a locking cover being selected on the one hand, and a two-part design including a locking cover and a stator being selected on the other hand. In this case, the stator unit includes an integral cover, i.e., one that is connected thereto as a single piece.

Stator cover units of this type have become common components in the meantime, and are used in newer internal combustion engines of motor vehicles. They are part of a camshaft adjuster as described above and are thus used to actuate the camshaft or the cams mounted on the camshaft. Due to the cams of the camshaft, which is set into rotation by a crankshaft, gas exchange valves in an internal combustion engine may be actuated thereby. The control times of the gas exchange valves may be purposefully defined with the aid of the configuration and shape of the cams. An adjustment of the valve opening times via the camshaft adjuster permits an increase in efficiency of the internal combustion engine, which is felt, in particular, as performance gain and fuel savings. For this reason, additional improvements are strived for again and again in camshaft adjusters or the individual components of a camshaft adjuster.

A camshaft adjuster usually includes a stator, a locking cover, a rotor positioned in the stator as well as a sealing cover. In the installed state, the stator is rotatably fixedly connected to a crankshaft, while the rotor is rotatably fixedly connected to a camshaft. The stator is usually designed to have at least one vane abutment surface, against which the vanes of a rotor abut in the installed state. On the whole, a targeted rotation of the camshaft with respect to the stator within a predetermined angle range is made possible by the use of a camshaft adjuster. The phase angle of the camshaft with respect to the crankshaft may thus be changed within certain limits.

To be able to maintain the stator and rotor in an optimum position, in particular during startup or idling of an engine, a sliding block is introduced within the locking cover. The sliding block is used for the rotatably fixed locking of a rotor, a piston engaging with the sliding block so that the stator cover unit is mechanically connected to a rotor in a form-fitting manner. As a result, high forces act upon the sliding block in the locked state.

However, the disadvantage of known stator cover units, for example in a unit known from U.S. Pat. No. 6,311,654 B1, is their relatively high manufacturing and assembly complexity.

Due to the installation space restrictions and customer specifications with regard to a driving plane, such as a belt plane, the fact that the locking cover is unable to be clamped and rotated in the circumferential direction directly via the gripper used occurs over and over again. This problem increases in a locking cover situated axially within an offset mounted part. A greater assembly complexity is required and, in the worst case, the desired adjuster concept may not even be implemented due to an imprecise assembly, since the locking cover is situated axially within another component, for example a belt pulley stator unit. Assembly is made even more difficult if a restoring spring must be pretensioned with the locking cover.

SUMMARY OF THE INVENTION

It is an object of the present invention to eliminate these disadvantages and to provide, during assembly, a marketable locking clearance in a camshaft adjuster despite a locking cover which is unable to be directly gripped or is difficult to grip during assembly, without greatly increasing the assembly complexity—even if a restoring spring is used.

The present invention provides in a stator cover unit, that the stator and the locking cover are rotatably fixedly secured in this position, at least during assembly, via a projection on one of the two components, which engages in a form-fitting manner with a recess in the other of the two components.

To achieve a marketable locking clearance during assembly of the camshaft adjuster without having to directly grip the locking cover in the circumferential direction, a so-called "interference contour" of the interfering component during gripping of the locking cover may be used. Since the locking cover is situated within the interfering component, the latter may be effectively coaxially aligned with the inner contour at predetermined points on the outer contour, the inner and outer contours of the two components resembling each other.

Due to the form fit achieved, a fixed abutment is generated, by means of which the locking clearance is set. The result is high precision.

In the approach according to the present invention, the cover is a component separate from the stator. The stator may have a pot-shaped design with a cover-like base, or it may be designed without a cover-like base of this type.

Setting the locking clearance without active torsion of the locking cover with the aid of an assembly device is possible. For this purpose, it is advantageous if the outer diameter of the locking cover is adapted to the inner diameter of the offset counter-contour in such a way that a preferably small coaxiality error results. The locking cover is thus centered on the inner diameter of the counter-contour with the aid of a form fit. A second axial contour is furthermore advantageous, e.g. in the form of a groove and pivot, which orient the two components in a predefined angular position. After the axial joining of the locking cover with the counter-contour, a defined locking clearance is generated by the restoring torque acting upon the locking cover or by an existing spring.

It is even possible to situate the locking cover lower down relative to the stator and the annular gear configuration, which surround the locking cover.

It is thus advantageous if the projection is designed as an integral component of the stator or the locking cover and extends in the radial and/or axial direction(s).

It is furthermore advantageous if the recess is designed as a circumferential or axial notch in the plate-like locking cover or is alternatively designed as an axial or radial indentation in the stator.

In terms of manufacturing, it has proven to be particularly advantageous if the projection is situated on the stator, and if the recess is located on the locking cover. Advantages arise particularly in combination with the manufacture of a sealing area, since, for example, targeted grinding may be dispensed with and pitch circle-flexible rotary operations may be used.

One advantageous variant is also characterized in that the projection and the recess are situated outside a sealing area, ensuring a fluid seal on the stator and the locking cover. Due to the situation outside the sealing area, preferably radially outside thereof, it is possible to avoid fluid, such as oil, exiting or entering the cavity between the locking cover, the rotor and the stator. The sealing area is not perforated.

If a plurality of projections and recesses situated equidistantly apart exists, preferably three projections and recesses or preferably four of each, the occurring forces may be captured and a secure assembly may be efficiently ensured.

It is also advantageous if the projection extends in the axial direction, and lateral abutment surfaces situated thereon, preferably a lateral abutment surface situated thereon having a counter-abutment surface of the recess, may be brought into contact or is provided. A defined angular position between the locking cover and the stator may then be set.

A structure of the stator may be achieved with particular stability and cost-effectiveness if it is manufactured from sintered material. In principle, it is also possible to rotatably fixedly connect the stator to the annular gear and manufacture these two component non-integrally, i.e., not in one piece, the other features of the invention also being implementable in a stator cover unit having an annular gear of this type and a stator.

It is furthermore advantageous if the projection has a polygonal outer contour, for example in the manner of a rectangle or a triangle. The projection may then have a block-like, in particular cuboid, design and provide a sufficiently large abutment surface for the counter-abutment surface.

Assembly is also facilitated if a spring for inducing a torsion of the locking cover relative to the stator is situated between the stator and the locking cover, this spring being situated in such a way that the spring force provided thereby pushes the counter-abutment surface onto the abutment surface. Once the locking cover has been inserted into the stator, the locking cover is automatically pushed into its assembly position by the spring, even if the locking cover is situated offset axially to the inside with respect to the axially outer stator edge, i.e., if the stator projects axially over the locking cover.

The present invention also relates to a camshaft adjuster having a rotor and a stator cover unit adjustably connected thereto, as explained above, it being possible to introduce a piston, movable in the axial direction, into an opening in the locking cover. When the piston is inserted into the opening, a form fit, which locks the two components, is generated.

BRIEF DESCRIPTION OF THE DRAWINGS

The present invention is also explained in greater detail below with the aid of a drawing.

DETAILED DESCRIPTION

Figure 1:
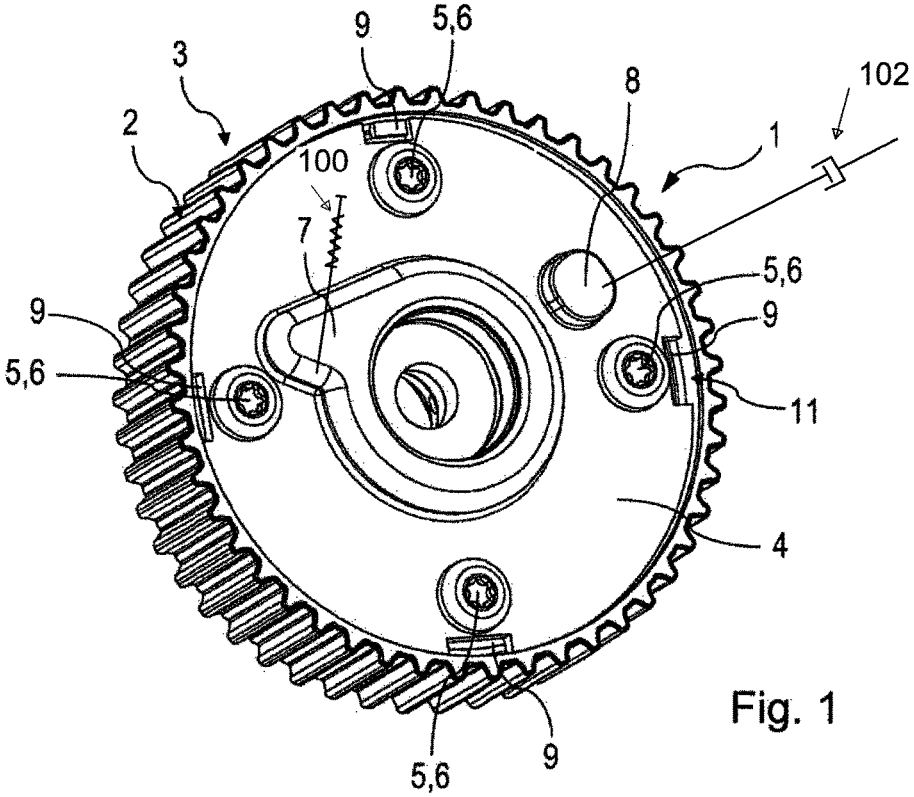
FIG. 1 shows a perspective view of a stator cover unit in the as yet uninstalled state in a camshaft adjusting mechanism.

The figures are only schematic and are used only for the sake of understanding the present invention. Identical elements are provided with identical reference numerals.

A first specific embodiment of a stator cover unit according to the present invention is illustrated in FIG. 1. This stator cover unit has reference numeral 1. The stator cover unit has an annular gear 2, a stator 3 and a locking cover 4. Locking cover 4 has a plate-like design and may also be referred to as a locking plate. Locking cover 4 is connected to a second cover, which is not illustrated, or directly to stator 3 with the aid of fastening means 5, which are designed as screws 6. A tab-like bulge 7, which provides a contact surface for a spring, is situated on the outside of locking cover 4.

A spring 100, which is illustrated solely schematically and which, in the illustration according to FIG. 1, rotatably presses locking cover 4 counterclockwise relative to stator 3, is provided within the cavity formed by stator 3 and locking cover 4.

An opening 8, into which a piston 102 shown solely schematically may be inserted from the rotor, is provided within locking cover 4 for the purpose of locking the locking cover and thus also the stator 3 relative to a rotor, i.e., to carry out an ongoing determination of the relative rotational position of the two components with respect to each other for the purpose of fastening.

At least one projection 9, which axially projects away from stator 3, is provided on stator 3. In the present exemplary embodiment, only one single projection 9 is provided, which prevents an overdetermination. If multiple projections 9 are used, attention must be paid to the correspondingly adapted tolerance chains. In this case, a first projection 9 may theoretically come first, and additional projections may be added only at a later time. A total of three, or preferably four, projections 9 may be provided on stator 3. If four projections 9 are provided, they are all distributed at a 90° angle circumferentially on an axial surface. Each projection 9 has one abutment surface 10, which is clearly visible in FIG. 2.

Locking cover 4 has four recesses 11 on its circumference, all of which are provided at a 90° angle. More than four recesses 11 are also conceivable. Recesses 11 are designed as notches, so that three surfaces situated orthogonally with respect to each other are provided, of which the surface which may be brought into contact with abutment surface 10 is referred to as counter-abutment surface 12. Abutment surface 10 and counter-abutment surface 12 are finished using a machining or nonmachining method to provide a precise and preferably flat surface. Abutment and counter-abutment surfaces 10 and 12 act as contact and counter-contact surfaces.

Figure 2:
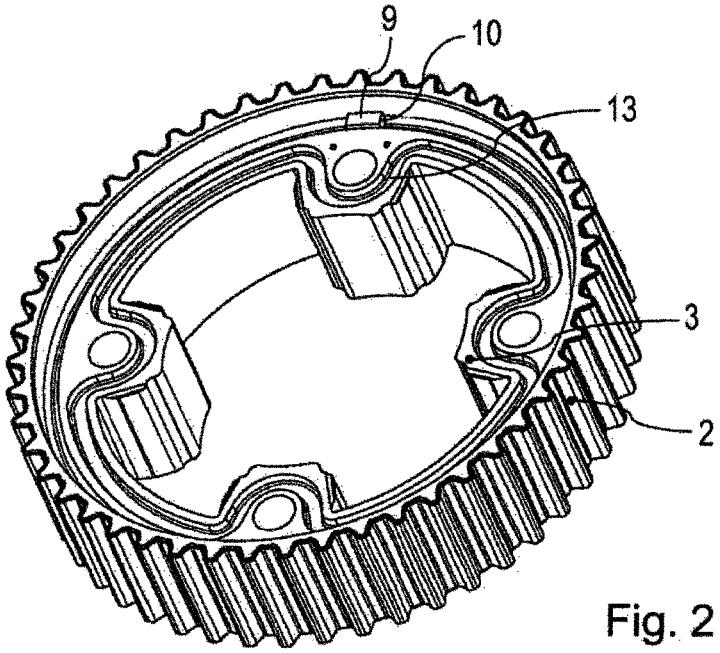
FIG. 2 shows the single stator of the stator cover unit from FIG. 1 without a locking cover.

As is apparent in FIG. 2, projection 9 is provided radially outside a sealing area 13. It is possible to use only a smaller number of projections 9 as abutment recesses 11.

Figure 3:
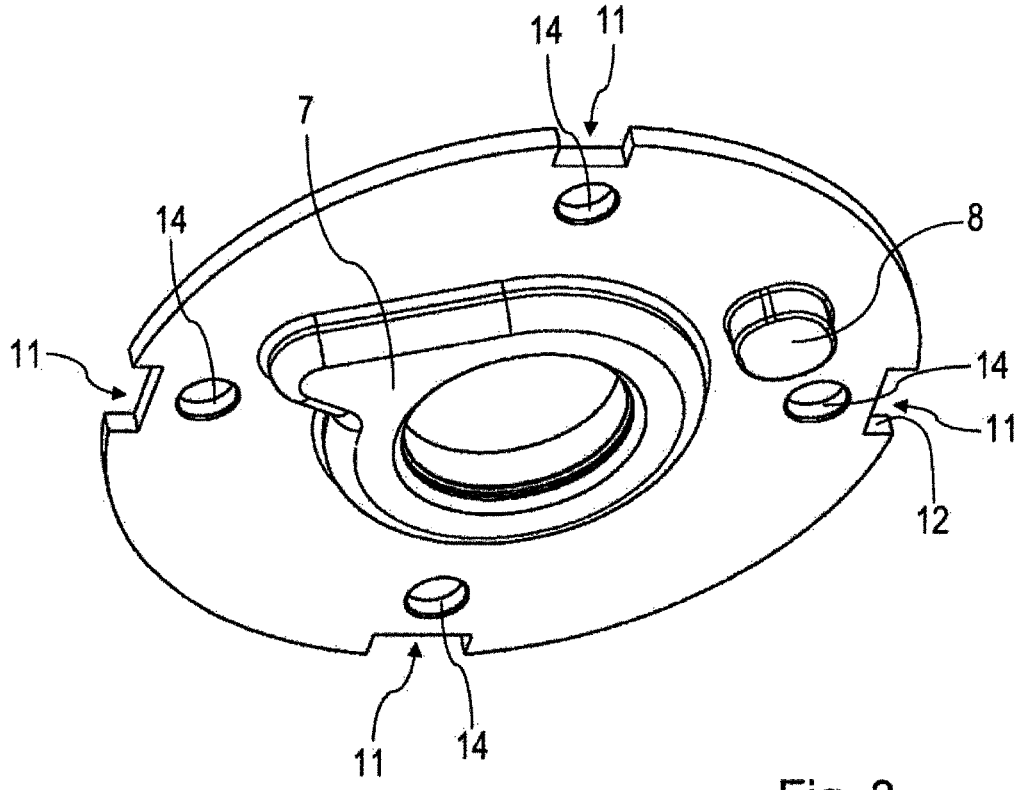
FIG. 3 shows a locking cover which is installed in the stator cover unit from FIG. 1 but is not yet installed in the stator according to FIG. 2.

In locking cover 4 illustrated in FIG. 3, four holes 14, into which screws 6 may be fitted, are provided radially within the same angle areas as recesses 11 on the same pitch circle.

Figure 4:
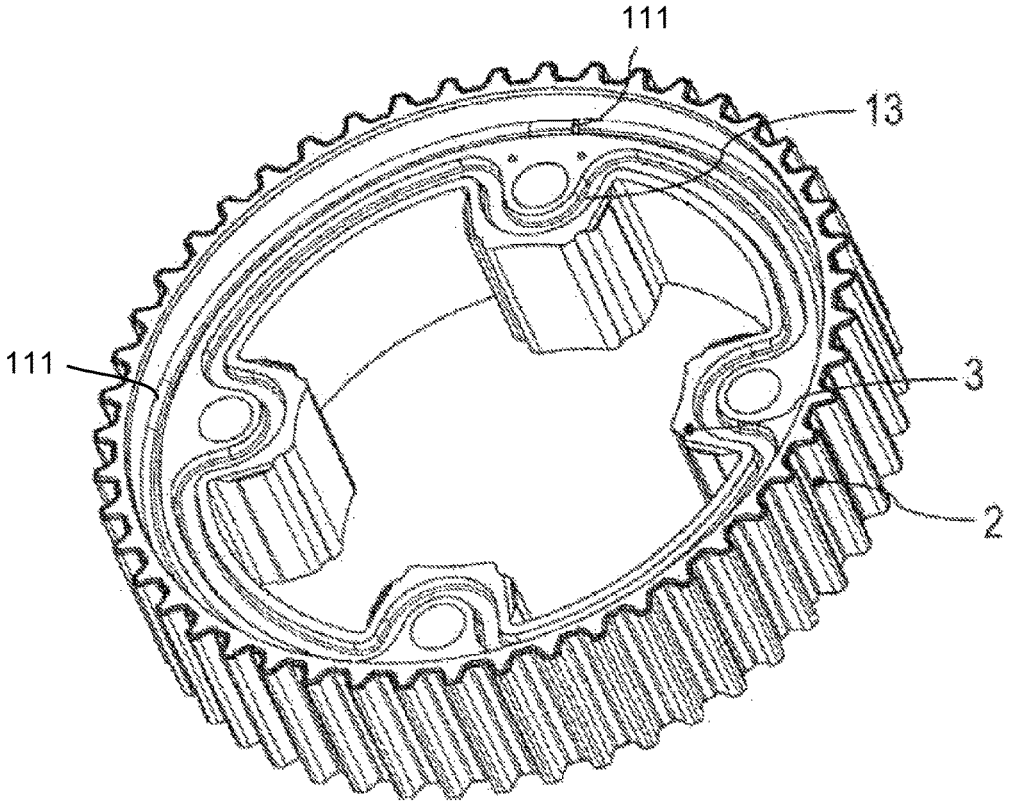
FIG. 4 shows a stator including recesses.
Figure 5:
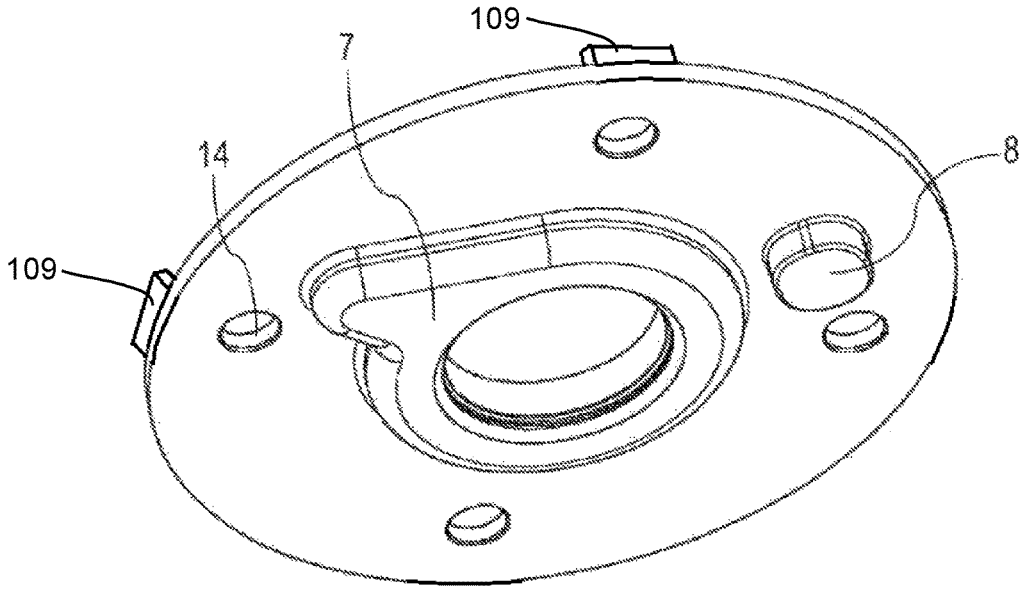
FIG. 5 shows a locking cover including projections.

FIGS. 4 and 5 illustrate an embodiment where the stator 3 and the locking cover 4 are rotatably fixably secured in position, at least during assembly, via a projection 109 on locking cover 4 engages in a form-fitting manner with a recess 111 on stator 3.

LIST OF REFERENCE NUMERALS

1 Stator cover unit
2 Annular gear
3 Stator
4 Locking cover
5 Fastening means
6 Screw
7 Bulge
8 Opening
9 Projection
10 Abutment surface
11 Recess
12 Counter-abutment surface
13 Sealing area
14 Hole
100 Spring
102 Piston

What is claimed is:

1. A camshaft adjuster comprising:

a stator cover unit, the stator cover unit comprising:

an annular gear for receiving a torque;

a stator, designed as a housing, being mounted on the annular gear; and a locking cover, separate from the stator, the locking cover being mounted torsion-proof on the stator, the stator and the locking cover being rotatably fixedly secured in a mounted position, at least during assembly, via a projection on one of the stator and the locking cover, the projection engaging with a form fit a recess on the other of the stator and the locking cover, the locking cover having an opening for receiving an axially movable piston, the form fit setting a locking clearance for the opening, the locking cover being at least partially axially situated within the stator.

2. The camshaft adjuster as recited in claim 1 wherein the projection is designed as an integral component of the stator or the locking cover and extends in a radial or axial direction.

3. The camshaft adjuster as recited in claim 1 wherein the recess is designed as a circumferential or axial notch in the locking cover or is alternatively designed as an axial or radial indentation in the stator.

4. The camshaft adjuster as recited in claim 1 wherein the projection and the recess are situated outside a sealing area, ensuring a fluid seal on the stator and the locking cover.

5. The camshaft adjuster as recited in claim 1 wherein a plurality of projections and recesses situated equidistantly apart are provided.

6. The camshaft adjuster as recited in claim 5 wherein the plurality of projections and recesses numbers three or four of each.

7. The camshaft adjuster as recited in claim 1 wherein the projection extends in an axial direction, and an abutment surface situated on the projection is in contact with a lateral counter-abutment surface of the recess.

8. The camshaft adjuster as recited in claim 1 wherein the stator is manufactured from sintered material.

9. The camshaft adjuster as recited in claim 1 wherein the projection has a polygonal outer contour.

10. The camshaft adjuster as recited in claim 9 wherein the contour is rectangular.

11. The camshaft adjuster as recited in claim 1 further comprising a spring for inducing a torsion of the locking cover relative to the stator and provided between the stator and the locking cover, the spring being situated in such a way that a spring force provided thereby pushes a counter-abutment surface onto an abutment surface.

12. The camshaft adjuster as recited in claim 1 wherein the stator and the locking cover are configured such that the locking clearance is settable without active torsion of the locking cover.

13. The camshaft adjuster as recited in claim 1 wherein the annular gear is fixed directly to the stator.

14. The camshaft adjuster as recited in claim 13 wherein the annular gear is formed as a singular piece with the stator.

15. The camshaft adjuster as recited in claim 14 wherein a contour of the single piece surrounds an outer contour of the locking cover.

16. The camshaft adjuster as recited in claim 1 wherein the gear surrounds the locking cover.

17. The camshaft adjuster in claim 1 wherein the gear surrounds the stator.

18. A camshaft adjuster comprising:

a stator cover unit, the stator cover unit comprising:

an annular gear for receiving a torque;

a stator, designed as a housing, being mounted on the annular gear; and a locking cover, separate from the stator, the locking cover being mounted torsion-proof on the stator, the stator and the locking cover being rotatably fixedly secured in a mounted position, at least during assembly, via a projection on one of the stator and the locking cover formed integrally as a single piece with the one of the stator and the locking cover, the projection engaging with a form fit a recess on the other of the stator and the locking cover, the locking cover having an opening for receiving an axially movable piston, the form fit setting a locking clearance for the opening, the projection being an axial projection that extends axially past an axially facing surface of the one of the stator and the locking cover of which the axial projection is on.

19. The camshaft adjuster as recited in claim 18 wherein the recess is an axial notch or indentation extending axially into a further axially facing surface of the one of the stator and the locking cover of which the axial projection is on.

* * * * *